US007464517B2

(12) United States Patent
Akatsuka et al.

(10) Patent No.: US 7,464,517 B2
(45) Date of Patent: Dec. 16, 2008

(54) SHOCK ABSORBING MATERIAL FOR PACKAGING AND DEAERATION PACKAGING METHOD

(75) Inventors: Hiroki Akatsuka, Tokyo (JP); Kazuhiro Mashima, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/542,374

(22) PCT Filed: Oct. 19, 2004

(86) PCT No.: PCT/JP2004/015430

§ 371 (c)(1),
(2), (4) Date: Jul. 14, 2005

(87) PCT Pub. No.: WO2005/047138

PCT Pub. Date: May 26, 2005

(65) Prior Publication Data

US 2006/0130430 A1 Jun. 22, 2006

(30) Foreign Application Priority Data

Nov. 14, 2003 (JP) ..... 2003-385277

(51) Int. Cl.
*B65B 23/00* (2006.01)

(52) U.S. Cl. ..... 53/433; 53/115; 53/472; 206/523; 206/524.8

(58) Field of Classification Search ..... 53/115, 53/433, 472; 206/523, 524.8, 592
See application file for complete search history.

(56) References Cited

U.S. PATENT DOCUMENTS

| | | | | | |
|---|---|---|---|---|---|
| 2,364,012 | A * | 11/1944 | Walton et al. | ..... | 229/117.28 |
| 3,752,301 | A * | 8/1973 | Bluemel | ..... | 206/583 |
| 4,052,931 | A * | 10/1977 | Morse et al. | ..... | 493/101 |
| 4,398,212 | A * | 8/1983 | Serry et al. | ..... | 348/61 |
| 4,941,572 | A * | 7/1990 | Harris | ..... | 206/423 |
| 5,788,078 | A * | 8/1998 | Fuss | ..... | 206/521 |
| 5,934,473 | A * | 8/1999 | Belshe | ..... | 206/583 |
| 5,988,493 | A * | 11/1999 | Clougherty | ..... | 229/164.2 |
| 5,996,798 | A * | 12/1999 | Gessert | ..... | 206/521 |
| 6,128,889 | A * | 10/2000 | Fuss | ..... | 53/472 |
| 7,117,993 | B2 * | 10/2006 | Koike | ..... | 206/320 |
| 7,128,208 | B2 * | 10/2006 | Hull | ..... | 206/363 |
| 2001/0030141 | A1 * | 10/2001 | Kasakura | ..... | 206/592 |

(Continued)

FOREIGN PATENT DOCUMENTS

JP 62-38221 B2 8/1987

(Continued)

*Primary Examiner*—Thanh K Truong
(74) *Attorney, Agent, or Firm*—Sughrue Mion, PLLC

(57) ABSTRACT

A styrofoam material 2 is placed in a corrugated carton 1, and a plastic bag 3 is then loaded into the corrugated carton 1. Air between any two of the corrugated carton 1, the styrofoam material 2, and the plastic bag 3 is evacuated so that the plastic bag 3 is adhered onto dented portions 2*a* for product placement of the styrofoam material 2, and inner surfaces of the corrugated carton 1. As a result, products 4 can be easily placed on the styrofoam material 2 onto which the plastic bag 3 is loaded without the products 4 getting snagged on the plastic bag 3 and the plastic bag 3 being torn.

6 Claims, 6 Drawing Sheets

U.S. PATENT DOCUMENTS

| | | | | |
|---|---|---|---|---|
| 2002/0189970 | A1* | 12/2002 | Koike | 206/592 |
| 2003/0209464 | A1* | 11/2003 | Otsuka et al. | 206/586 |
| 2005/0167305 | A1* | 8/2005 | Park | 206/320 |

FOREIGN PATENT DOCUMENTS

| | | | |
|---|---|---|---|
| JP | 63-164477 | U | 10/1988 |
| JP | 4-352663 | A | 12/1992 |
| JP | 9-95361 | A | 4/1997 |
| JP | 10-86908 | A | 4/1998 |
| JP | 2002-337948 | A | 11/2002 |

* cited by examiner

SHOCK ABSORBING MATERIAL FOR PACKAGING AND DEAERATION PACKAGING METHOD

FIELD OF THE INVENTION

The present invention relates to an improvement in a styrofoam material which is used when products are packaged in a corrugated carton, and relates to a shock absorbing material for packaging and a deaeration packaging method which make it easy to package products using deaeration etc.

BACKGROUND OF THE INVENTION

There has been provided a related art shock absorbing material for packaging in which a styrofoam material provided with two or more outlets is inserted into a bag-shaped plastic sheet, air in the bag-shaped plastic sheet is sucked out, via the two or more outlets, from an opening of the plastic sheet so that the plastic sheet is adhered to a surface of the styrofoam material, and the opening of the plastic sheet is then closed.

Thus, a shock absorbing material for packaging of high strength can be provided by coating a styrofoam material with a plastic sheet. Furthermore, forming of two or more inlets in the styrofoam material makes it possible to adhere the plastic sheet to a surface of the styrofoam material efficiently at the time of sucking out the air in the plastic sheet (refer to patent reference 1, for example).

Patent reference 1: JP,2002-337948,A (refer to FIG. 8)

In the related art shock absorbing material for packaging which is constructed as mentioned above, the styrofoam material is coated with the plastic sheet in order to increase the strength of the styrofoam material, but this structure is not intended for facilitating the process of packaging products on the styrofoam material.

There has been also provided, as a related art packaging method, a method of loading a plastic bag onto a styrofoam material in advance, and placing two or more products on the plastic bag in order to protect products to be packaged from the moisture of outside air and to prevent chippings of the styrofoam material from being adhered to and mixed into the products. A problem with the related art packaging method is however that the products will get snagged on the plastic bag when placed on the plastic bag, thereby reducing the workability of the packaging, and this will result in tears in the plastic bag.

Therefore, there has been provided a method of placing two or more products on a styrofoam material after individually packaging the two or more products into plastic bags. A problem with this method of individually packaging two or more products into plastic bags is however that it takes a great deal of time, and therefore the workability of the packaging is reduced.

The present invention is made in order to solve the above-mentioned problems, and it is therefore an object of the present invention to provide a shock absorbing material for packaging and a deaeration packaging method which make it easy to place targets to be packaged on the shock absorbing material onto-which a thin film member for packaging which is thinly formed is loaded without the targets to be packaged getting snagged on the thin film member for packaging which is thinly formed and the thin film member being torn when placing the targets to be packaged on the shock absorbing material for packaging.

DISCLOSURE OF THE INVENTION

A shock absorbing material for packaging in accordance with the present invention includes a hole for deaeration which is formed so as to penetrate between a first surface thereof which is brought into contact with an inner surface of a packaging carton when the shock absorbing material is placed in the packaging carton, and a second surface thereof on which a target to be packed is placed via a thin film member for packaging which is thinly formed.

Since the shock absorbing material for packaging is thus equipped with the hole for deaeration which penetrates between the first and second surfaces, when the shock absorbing material for packaging is placed in the packing carton, and air is sucked out from the first surface using the deaerating duct after the thin film member for packaging which is thinly formed is loaded onto the second surface of the shock absorbing material for packaging, and into the packing carton, the air between any two of the thin film member for packaging which is thinly formed, the second surface, and the packing carton is evacuated via the hole for deaeration, so that the thin film member for packaging which is thinly formed is adhered to the second surface according to the shape of the second surface, and is also adhered to the packing carton.

As a result, the present invention offers an advantage of making it easy to place targets to be packaged on the second surface of the shock absorbing material onto which the thin film member for packaging which is thinly formed is loaded without the targets to be packaged getting snagged on the thin film member for packaging which is thinly formed and the thin film member being torn when placing the targets to be packaged on the second surface of the shock absorbing material for packaging.

PREFERRED EMBODIMENTS OF THE INVENTION

Hereafter, in order to explain this invention in greater detail, the preferred embodiments of the present invention will be described with reference to the accompanying drawings.

Embodiment 1

Figure 1:
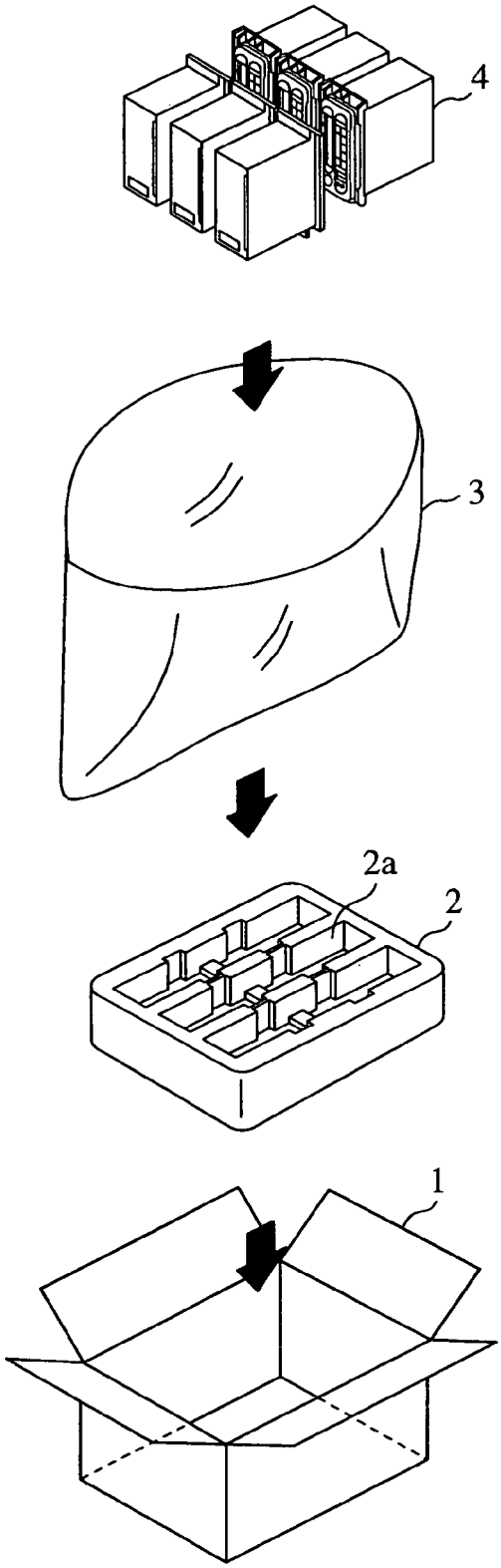
FIG. 1 is a perspective view showing steps of a deaeration packaging method in accordance with embodiment 1 of the present invention.
Figure 2:
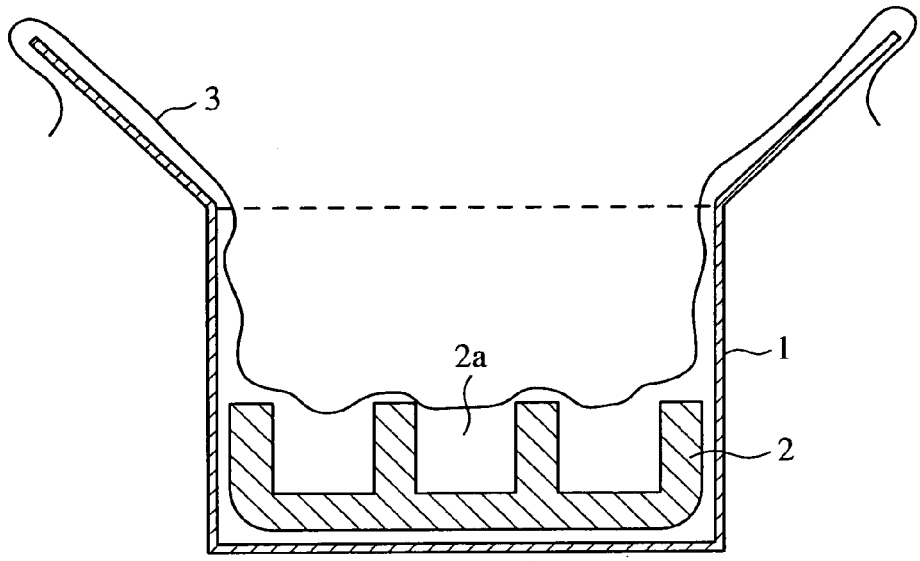
FIG. 2 is a cross-sectional view showing a problem which arises at a time of loading a plastic bag into a corrugated carton.
Figure 3:
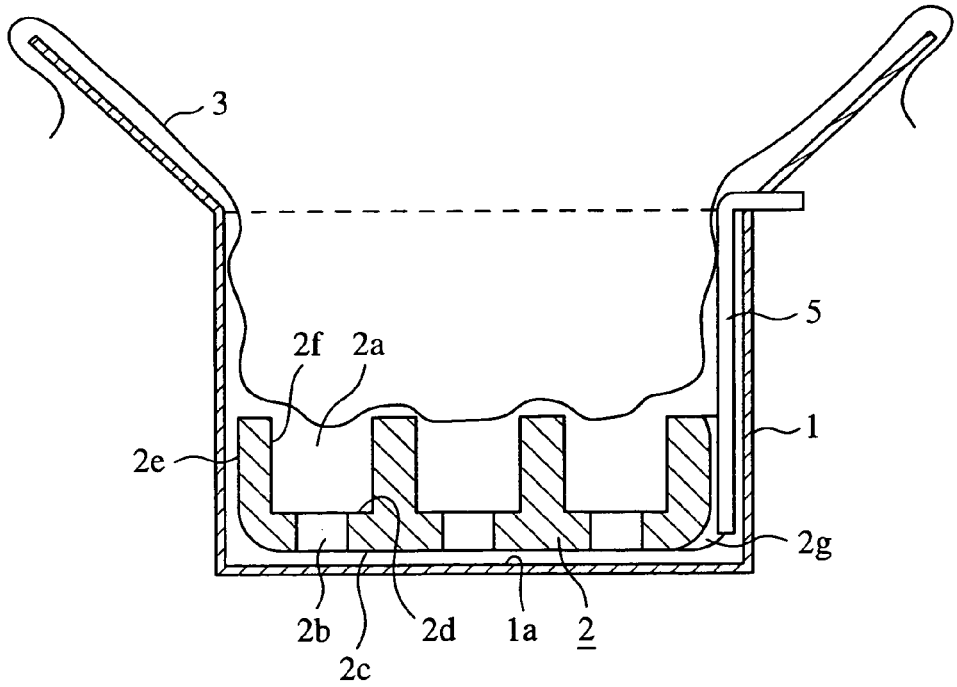
FIG. 3 is a cross-sectional view showing a state in which a deaerating duct is inserted into the corrugated carton when the plastic bag is loaded into the corrugated carton.
Figure 4:
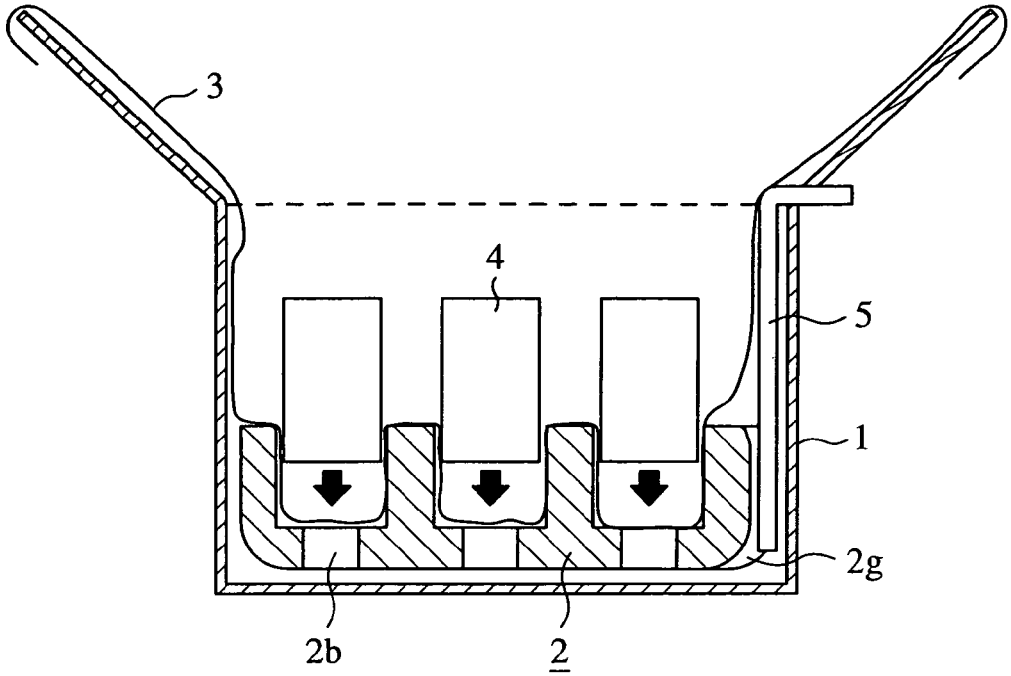
FIG. 4 is a cross-sectional view showing a state in which products are placed in the corrugated carton after air is suck out using the deaerating duct.

FIG. 1 is a perspective view showing steps of a deaeration packaging method in accordance with embodiment 1 of the present invention, FIG. 2 is a cross-sectional view showing a problem which arises at the time of loading, for example, a plastic bag which is a thin film member for packaging which is thinly formed, into a corrugated carton, FIG. 3 is a cross-sectional view showing a state in which a deaerating duct is inserted into the corrugated carton when the plastic bag is loaded into the corrugated carton, and FIG. 4 is a cross-sectional view showing a state in which products are placed in the corrugated carton after air is suck out via the deaerating duct.

In the figures, the corrugated carton (i.e., a container) 1 has a lid on a back surface thereof which is fastened with a gummed tape or the like, and has a normal structure. A styrofoam material (i.e., a shock absorbing material for packaging) 2 has a plurality of dented portions 2*a* for product placement which are formed in a surface thereof, and is placed in the corrugated carton 1. After the styrofoam material 2 is placed in the corrugated carton 1, a plastic bag (i.e., a thin film member for packaging which is thinly formed) 3 is loaded onto the styrofoam material 2 and into the corrugated carton 1. After the plastic bag 3 is adhered onto both the plurality of dented portions 2*a* for product placement of the styrofoam material 2 and inner surfaces of the corrugated carton 1, products (i.e., targets to be packaged) 4 are placed on the plurality of dented portions 2*a* for product placement of the styrofoam material 2, respectively.

As shown in FIGS. 3 and 4, the deaerating duct 5 is inserted between the corrugated carton 1 and both the styrofoam material 2 and the plastic bag 3, and the plastic bag 3 is adhered onto both the plurality of dented portions 2*a* for product placement of the styrofoam material 2 and inner surfaces of the corrugated carton 1 by sucking out air between any two of the corrugated carton 1, the styrofoam material 2, and the plastic bag 3.

Figure 5:
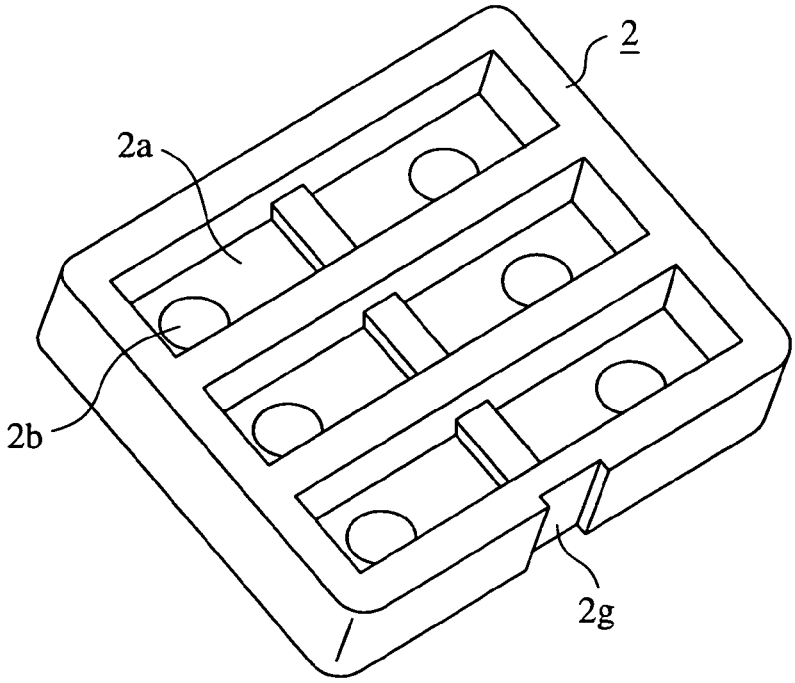
FIG. 5 is a perspective view showing a surface of the styrofoam material in accordance with embodiment 1 of the present invention.

As shown in FIG. 5, a circle-shaped penetrating hole (i.e. a hole for deaeration) 2*b* is formed in each of the plurality of dented portions 2*a* for product placement of the styrofoam material 2. This penetrating hole 2*b* is disposed so as to penetrate between a back surface (i.e., a first surface) 2*c* of the styrofoam material 2 which is brought into contact with a bottom surface 1*a* of the corrugated carton 1 when the styrofoam material 2 is placed in the corrugated carton 1, and a bottom surface (i.e., a second surface) 2*d* of a corresponding dented portion on which a product 4 is placed via the plastic bag 3. In addition to penetrating holes 2*b* which are disposed so as to penetrate between the back surface 2*c* of the styrofoam material 2, and the bottom surfaces 2*d* of the plurality of dented portions, a penetrating hole can be disposed so as to penetrate between an outer lateral surface (i.e., a first surface) 2*e* and an inner lateral surface (i.e., a second surface) 2*f* of the styrofoam material 2.

A deaerating-duct insertion opening into which the deaerating duct 5 can be inserted is formed in the lateral surface 2*e* of the styrofoam material 2 so that the insertion opening is communicated with the back surface 2*c* of the styrofoam material 2.

Next, the steps of the deaeration packaging method in accordance with this embodiment of the present invention will be explained.

As shown in FIG. 1, the styrofoam material 2 is placed in the corrugated carton 1 first (shock absorbing material placing step). This styrofoam material 2 buffers vibrations from outside to products 4 which are placed thereon. The plurality of dented portions 2*a* for product placement are formed in the surface of the styrofoam material 2 so that six products 4 can be simultaneously packaged therein.

Next, the plastic bag 3 is loaded onto the styrofoam material 2 and into the corrugated carton 1 (sheet loading step). This plastic bag 3 is loaded in order to protect the six products 4 from the moisture of outside air and to prevent chippings of the styrofoam material 2 from being adhered to and mixed into the six products 4.

As shown in FIG. 2, after the plastic bag 3 is loaded onto the styrofoam material and into the corrugated carton, if six products 4 are tried to be placed in the plurality of dented portions 2*a* for product placement, respectively, without sucking out the air between any two of the corrugated carton 1, the styrofoam material 2, and the plastic bag 3, the six products 4 will get snagged on the plastic bag 3 and therefore the plastic bag 3 will be torn since the plastic bag 3 is not adhered onto the plurality of dented portions 2*a* for product placement of the styrofoam material 2.

In contrast, in accordance with this embodiment 1, the styrofoam material 2 is placed in the corrugated carton 1 first, and the plastic bag 3 is loaded onto the styrofoam material 2 and into the corrugated carton 1, as shown in FIG. 3. Then, in accordance with this embodiment 1, the deaerating duct 5 is inserted into the deaerating-duct insertion opening after the plastic bag 3 is loaded onto the styrofoam material and into the corrugated carton, and the air between any two of the corrugated carton 1, the styrofoam material 2, and the plastic bag 3 is evacuated via the plurality of penetration holes 2*b*, and space between the bottom surface 1*a* of corrugated carton 1 and the back surface 2*c* of the styrofoam material 2 by sucking out the air using the deaerating duct 5, so that the plastic bag 3 is adhered onto the plurality of dented portions 2*a* for product placement of the styrofoam material 2, and inner surfaces of the corrugated carton 1.

Then, as shown in FIG. 4, after the plastic bag 3 is adhered onto the plurality of dented portions 2*a* for product placement of the styrofoam material 2 and inner surfaces of the corrugated carton 1, six products 4 are placed in the plurality of dented portions 2*a* for product placement of the styrofoam material 2, respectively.

As mentioned above, in accordance with this embodiment 1, since the styrofoam material 2 is provided with the plurality of penetrating holes 2*b*, by placing the styrofoam material 2 in the corrugated carton 1, and sucking out air using the deaerating duct 5 after loading the plastic bag 3 onto the plurality of dented portions 2*a* for product placement of the styrofoam material 2 and into the corrugated carton 1, the air between the plastic bag 3 and the styrofoam material 2 is evacuated via the plurality of penetrating holes 2*b* so that the plastic bag 3 is adhered onto the plurality of dented portions 2*a* for product placement according to their shape and also onto the corrugated carton 1. As a result, products 4 can be easily placed in the plurality of dented portions 2*a* for product placement of the styrofoam material 2 onto which the plastic bag 3 is loaded without the products 4 getting snagged on the plastic bag 3 and the plastic bag 3 being torn.

In addition, since the styrofoam material has the deaerating-duct insertion opening 2*g*, the deaerating duct 5 can be easily inserted between the plastic bag 3 and the styrofoam material 2 via the deaerating-duct insertion opening 2*g* in order to suck out the air between the plastic bag 3 and the styrofoam material 2 via the plurality of penetrating holes 2*b* and space between the bottom surface 1*a* of the corrugated carton 1 and the back surface 2*c* of the styrofoam material 2 by using the deaerating duct 5, thereby increasing the efficiency of deaeration.

Embodiment 2

Figure 6:
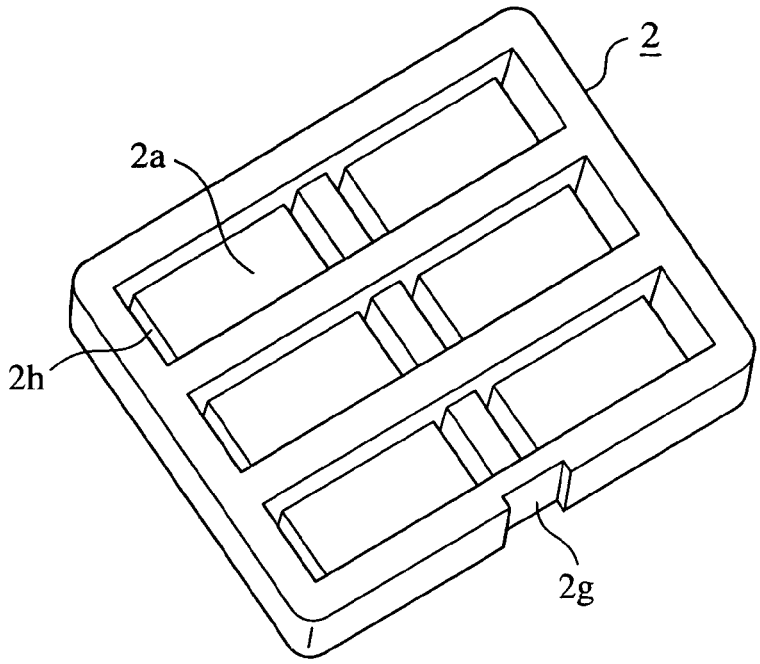
FIG. 6 is a perspective view showing a surface of a styrofoam material in accordance with embodiment 2 of the present invention.
Figure 7:
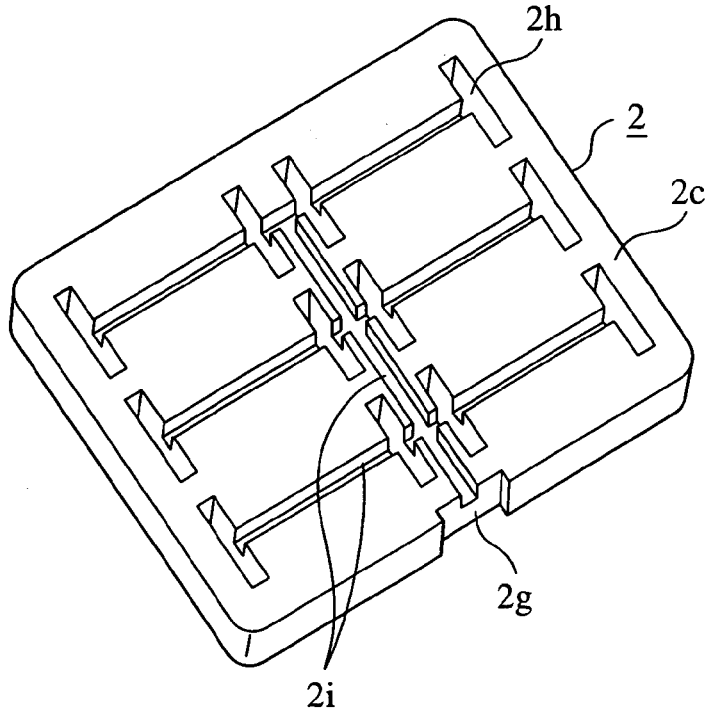
FIG. 7 is a perspective view showing a back surface of the styrofoam material.
Figure 8:
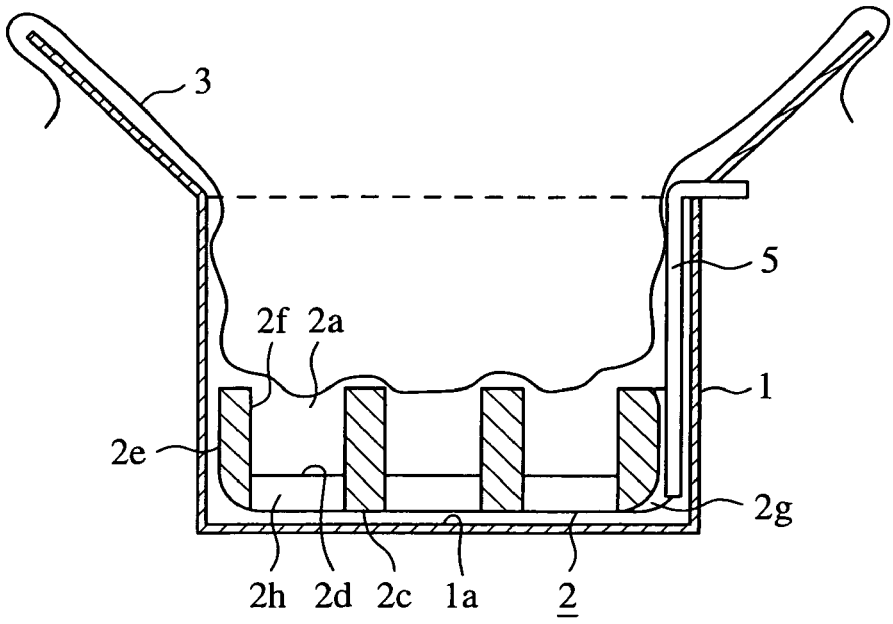
FIG. 8 is a cross-sectional view showing a state in which a deaerating duct is inserted into a corrugated carton when a plastic bag is loaded into the corrugated carton.

FIG. 6 is a perspective view showing a surface of a styrofoam material in accordance with embodiment 2 of the present invention, FIG. 7 is a perspective view showing a back surface of the styrofoam material, and FIG. 8 is a cross-sectional view showing a state in which a deaerating duct is inserted when a plastic bag is loaded into a corrugated carton.

As shown in FIGS. 6 to 8, rectangle-shaped penetrating holes (i.e., holes for deaeration) 2*h* are formed on both sides of a bottom surface 2*d* of each of a plurality of dented portions 2*a* for product placement of the styrofoam material 2. These penetrating holes 2*h* are disposed so as to penetrate between a back surface (i.e., a first surface) 2*c* of the styrofoam material 2 which is brought into contact with a bottom surface 1*a* of the corrugated carton 1 when the styrofoam material 2 is placed in the corrugated carton 1, and a bottom surface (i.e., a second surface) 2*d* of a corresponding dented portion on which a product 4 is placed via the plastic bag 3. In addition to penetrating holes 2*b* which are disposed so as to penetrate between the back surface 2*c* of the styrofoam material 2, and the bottom surfaces 2*d* of the plurality of dented portions, a penetrating hole can be disposed so as to penetrate between an outer lateral surface (i.e., a first surface) 2*e* and an inner lateral surface (i.e., a second surface) 2*f* of the styrofoam material 2.

Grooves (i.e., grooves for deaeration) 2*i* which provide communication between a deaerating-duct insertion opening 2*g* and the penetrating holes 2*h* are formed in the back surface 2*c* of the styrofoam material 2.

The other structure of the styrofoam material is the same as that shown in FIGS. 3 and 4.

Next, steps of a deaeration packaging method in accordance with this embodiment of the present invention will be explained.

As shown in FIGS. 6 to 8, the styrofoam material 2 is placed in the corrugated carton 1 first, and the plastic bag 3 is loaded onto the styrofoam material 2 and into the corrugated carton 1. Then, the deaerating duct 5 is inserted into the deaerating-duct insertion opening 2*g* after the plastic bag 3 is loaded onto the styrofoam material and into the corrugated carton, and air between any two of the corrugated carton 1, the styrofoam material 2, and the plastic bag 3 is evacuated via the plurality of penetration holes 2*b*, and space between the bottom surface 1*a* of the corrugated carton 1 and the grooves 2*i* of the styrofoam material 2 by sucking out the air using the deaerating duct 5, so that the plastic bag 3 is adhered onto the plurality of dented portions 2*a* for product placement of the styrofoam material 2, and inner surfaces of the corrugated carton 1.

Then, after the plastic bag 3 is adhered onto the plurality of dented portions 2*a* for product placement of the styrofoam material 2 and inner surfaces of the corrugated carton 1, six products 4 are placed in the plurality of dented portions 2*a* for product placement of the styrofoam material 2, respectively.

As mentioned above, in accordance with this embodiment 2, since the two penetrating holes 2*d* are formed in the both sides of the bottom surface 2*d* of each of the plurality of dented portions 2*a* for product placement of the styrofoam material 2, the air between any two of the corrugated carton, the styrofoam material, and the plastic bag is evacuated from the both sides of each of the plurality of dented portions 2*a* for product placement on a priority basis when the air is sucked out using the deaerating duct 5. Therefore, this embodiment can prevent air from remaining in the vicinity of the both sides of each of the plurality of dented portions 2*a* for product placement, thereby increasing the degree of adhesion with the plastic bag 3 in the vicinity of the both sides of each of the plurality of dented portions 2*a*.

Since the grooves 2*i* providing communication between the deaerating-duct insertion opening 2*g* and the plurality of penetrating holes 2*h* are formed in the back surface of the styrofoam material, the air between any two of the corrugated carton, the styrofoam material, and the plastic bag can be evacuated through space between the grooves 2*i* which are communicated with the penetrating holes 2*h*, and the bottom surface 1*a* of the corrugated carton 1 when the air is sucked out using the deaerating duct 5, thereby increasing the efficiency of deaeration.

The efficiency of deaeration can be further increased by adjusting and determining the positions, shapes, and sizes of the penetrating holes 2*h*, and the routes and sizes of the grooves 2*i* according to determination of the shape of the plurality of dented portions 2*a* for product placement of the styrofoam material 2. In the illustrated example, the grooves 2*i* are formed only in the back surface (i.e., the first surface) of the styrofoam material 2 which is brought into contact with the bottom surface 1*a* of the corrugated carton 1. As an alternative, the grooves 2*i* can be formed in the bottom surfaces (i.e., the second surfaces) of the plurality of dented portions 2*a*, or in both the first and second surfaces.

Embodiment 3

Figure 9:
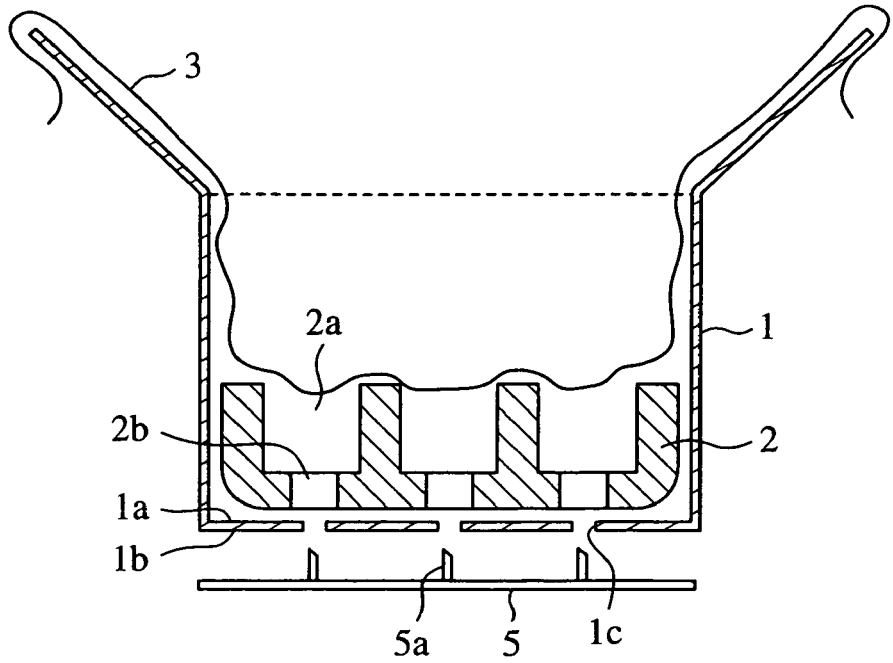
FIG. 9 is a cross-sectional view-showing a state in accordance with embodiment 3 of the present invention in which a deaerating duct is inserted into a corrugated carton when a plastic bag is loaded into the corrugated carton.
Figure 10:
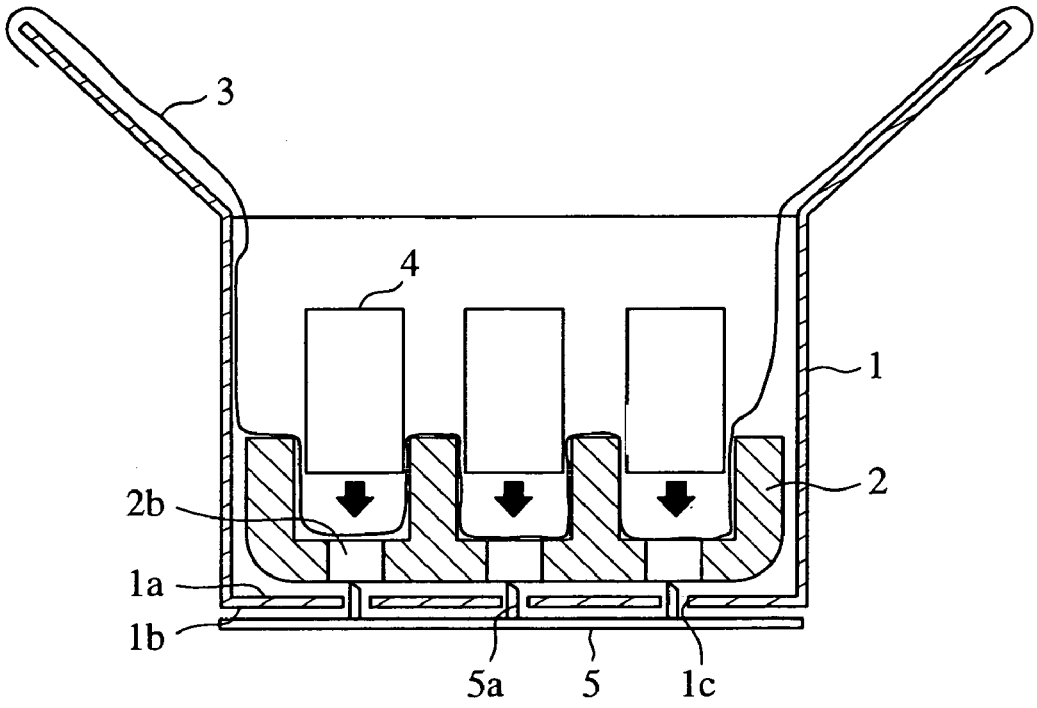
FIG. 10 is a cross-sectional view showing a state in which products are placed in the corrugated carton after air is suck out using a deaerating nozzle.

FIG. 9 is a cross-sectional view showing a state in accordance with embodiment 3 of the present invention in which a deaerating nozzle is inserted into a corrugated carton when a plastic bag is loaded into the corrugated carton, and FIG. 10 is a cross-sectional view showing a state in which products are placed in the corrugated carton after air is suck out using the deaerating nozzle.

As shown in FIGS. 9 and 10, insertion holes 1*c* are formed in a bottom surface 1*a* of the corrugated carton 1 and at positions respectively corresponding to those of penetrating holes 2*b* of a styrofoam material 2 which is to be placed on the bottom surface 1*a* of the corrugated carton 1. A deaerating duct 5 includes deaerating nozzles 5*a* formed thereon and at positions respectively corresponding to those of the insertion holes 1*c* of the corrugated carton.

The other structure of the styrofoam material is the same as that shown in FIGS. 3 and 4.

Next, steps of a deaeration packaging method in accordance with this embodiment of the present invention will be explained.

As shown in FIG. 9, the styrofoam material 2 is placed in the corrugated carton 1 first, and the plastic bag 3 is loaded onto the styrofoam material 2 and into the corrugated carton 1. Then, in accordance with this embodiment 3, after the plastic bag 3 is loaded onto the styrofoam material and into the corrugated carton, the deaerating nozzles 5*a* of the deaerating duct 5 are inserted from the back surface 1*b* of the corrugated carton 1 into the penetrating holes 2*b* of the styrofoam material 2 via the insertion holes 1*c* of the corrugated carton 1, respectively, and air between any two of the corrugated carton 1, the styrofoam material 2, and the plastic bag 3 is then evacuated via the penetrating holes 2*b* by sucking out the air using the deaerating duct 5, so that the plastic bag 3 is adhered onto a plurality of dented portions 2*a* for product placement of the styrofoam material 2, and inner surfaces of the corrugated carton 1.

Then, as shown in FIG. 10, after the plastic bag 3 is adhered onto the plurality of dented portions 2*a* for product placement of the styrofoam material 2 and inner surfaces of the corrugated carton 1, six products 4 are placed in the plurality of dented portions 2*a* for product placement of the styrofoam material 2, respectively.

As mentioned above, in accordance with this embodiment 3, the deaerating nozzles 5*a* of the deaerating duct 5 are inserted from the back surface 1*b* of the corrugated carton 1 into the penetrating holes 2*b* of the styrofoam material 2 via the insertion holes 1*c* of the corrugated carton 1, respectively, and the air between any two of the corrugated carton, the styrofoam material, and the plastic bag is evacuated. Therefore, the deaerating nozzles 5*a* can be easily inserted into penetrating holes of the styrofoam material and the deaeration can be easily performed without the deaerating nozzles 5*a* being caught between the plastic bag 3 and the corrugated carton 1.

In accordance with above-mentioned embodiment 3, the styrofoam material 2 has the penetrating holes 2*b* which are circle-shaped as shown in above-mentioned embodiment 1. As an alternative, the styrofoam material 2 can have penetrating holes 2*h* which are formed on both sides of a bottom surface 2*d* of each of the plurality of dented portions 2*a* for product placement, as shown in above-mentioned embodiment 2. In this case, the deaeration can be easily performed by using a deaerating duct 5 having a plurality of deaerating nozzles 5*a* whose positions are determined so as to correspond to those of the penetrating holes 2*h*.

By forming the deaerating nozzles 5*a* of the deaerating duct so that they are thin, have a large strength, and are sharp, like hypodermic needles, and inserting these deaerating nozzles directly into the back surface 1*b* of the corrugated carton 1, the deaeration can be also performed. In this case, since it is not necessary to form any insertion holes 1*c* in the bottom surface 1*a* of the corrugated carton 1, and the deaerating nozzles are thin, holes which are formed in the back surface of the corrugated carton by the insertion of the deaerating nozzles can be reduced in size and can be made inconspicuous.

INDUSTRIAL APPLICABILITY

As mentioned above, the shock absorbing material for packaging and deaeration packaging method in accordance with the present invention are suitable for facilitating packaging of products using deaeration when packaging the products in a corrugated carton.

The invention claimed is:

1. A packaging system comprising:

a packaging carton;

a single pad formed of shock absorbing material; and a deaerating-duct having deaerating nozzles formed thereon for sucking air, wherein a plurality of holes for deaeration is formed so as to penetrate through a first surface of the single pad, which is brought into contact with an inner surface of said packaging carton when said single pad is placed in said packaging carton, wherein said plurality of holes for deaeration is also formed so as to penetrate through a second surface of the single pad on which a product to be packed is placed via a thin film member, wherein said nozzles are inserted into said plurality of holes for deaeration via a deaerating-duct insertion openings formed through said packaging carton, wherein said deaerating-duct is provided under a bottom surface of said packaging carton, such that said deaerating duct is provided outside of said packaging carton, and wherein said deaerating-duct insertion openings are formed through said bottom surface of said packaging carton.

2. The packaging system according to claim 1, wherein the plurality of holes for deaeration are formed on a side of a dented portion provided in the second surface, the dented portion for placement of the product.

3. The packaging system according to claim 1, further comprising at least one dented portion in the second surface, the dented portion for placement of the product therein, wherein at least two holes for deaeration are formed in the dented portion.

4. The packaging system according to claim 1, wherein the plurality of holes are enclosed within the shock absorbing material.

5. The packaging system according to claim 1, wherein the plurality of holes are fully enclosed by the shock absorbing material around the perimeter of the holes.

6. The packaging system according to claim 1, wherein positions of said plurality of holes for deaeration correspond, respectively, to positions of said deaerating-duct insertion openings formed through said packaging carton.

* * * * *